US007740136B2

(12) United States Patent
Roesler

(10) Patent No.: US 7,740,136 B2
(45) Date of Patent: Jun. 22, 2010

(54) PACKAGING CONTAINER WITH CLAMPING BASE

(76) Inventor: Peter Roesler, Ifenweg 3, D-88239 Wangen/Allgau (DE)

( * ) Notice: Subject to any disclaimer, the term of this patent is extended or adjusted under 35 U.S.C. 154(b) by 395 days.

(21) Appl. No.: 11/611,170

(22) Filed: Dec. 15, 2006

(65) Prior Publication Data

US 2007/0138043 A1 Jun. 21, 2007

(30) Foreign Application Priority Data

Dec. 17, 2005 (DE) ..... 10 2005 060 439

(51) Int. Cl.
*B65D 85/28* (2006.01)

(52) U.S. Cl. ..... 206/379; 206/477; 206/480; 206/486

(58) Field of Classification Search ..... 206/372–379, 206/349, 443, 446, 486, 477, 480
See application file for complete search history.

(56) References Cited

U.S. PATENT DOCUMENTS

| | | | | |
|---|---|---|---|---|
| 1,614,807 | A * | 1/1927 | Evertte | 206/306 |
| 2,246,642 | A * | 6/1941 | Stachowiak | 131/256 |
| 4,099,618 | A * | 7/1978 | Ebner | 206/454 |
| 5,897,090 | A * | 4/1999 | Smith et al. | 248/311.2 |
| 5,967,318 | A | 10/1999 | Rosler | |
| 6,123,205 | A * | 9/2000 | Dumitrescu et al. | 211/74 |
| 6,273,255 | B1 * | 8/2001 | Rosler | 206/378 |
| 6,352,293 | B1 * | 3/2002 | Baschenis | 294/99.2 |
| 2003/0155274 | A1 * | 8/2003 | Rosler | 206/591 |
| 2008/0011789 | A1 | 1/2008 | Kiepe | |
| 2008/0185305 | A1 * | 8/2008 | Roesler | 206/349 |

FOREIGN PATENT DOCUMENTS

| | | | |
|---|---|---|---|
| DE | G 92 12 926.9 | U1 | 9/1992 |
| DE | 9212926.9 | | 3/1993 |
| DE | 197 30 696 | A1 | 10/1999 |
| DE | 20 2004 002 024 | U1 | 5/2005 |
| JP | 2007161346 | A * | 6/2007 |
| WO | 2005049450 | | 6/2005 |

* cited by examiner

*Primary Examiner*—J. Gregory Pickett
(74) *Attorney, Agent, or Firm*—Frederick L. Tolhurst, Esq.; Cohen & Grigsby, P.C.

(57) ABSTRACT

A packaging container with a clamping base and an attachable protective cap serves for a unilateral, clamping or holding of a tool, an instrument, or another longitudinal object, where the clamping base comprises a clamping holder with a plurality of springy clamping jaws fastened on one side which define a nearly centric, central clamping reception, in which clamping reception the tool is inserted and held clampingly.

In order to achieve that the insertion force to be applied is low when the packaging container is equipped, however, a high clamping force is given with the protective cap attached. The protective cap abuts against the outside circumference of the clamping jaws when it is attached to the clamping base and prestresses said clamping jaws in direction of the clamping reception.

22 Claims, 5 Drawing Sheets

PACKAGING CONTAINER WITH CLAMPING BASE

CLAIM OF PRIORITY

This invention claims the benefit of German Patent Application Serial No. 10 2005 060 439.0, filed on Dec. 17, 2005.

FIELD OF THE INVENTION

The invention refers to a packaging container with a clamping base, and particularly a packaging container having a clamping holder with at least one elastic clamping jaw.

BACKGROUND OF THE INVENTION

Such packaging container with a clamping base has become known as such that a cap can be slid on a base. By this the cap covers the object to be protected, for example a tool, an instrument, or any other object, which object is received by the base of the packaging container.

The known clamping base is developed as such that a clamping reception is formed in the area of the base by ribs arranged at the circumference uniformly distributed, which ribs are fixed at the internal surfaces of the base. At their corresponding ends the ribs project radially inwardly and as such they form a clamping reception. Since the ribs are made of a flexible material this results in a flexible clamping reception in case that the object to be held is inserted in the clamping reception which results in a partial deformation of these flexible ribs.

A disadvantage of this known clamping reception is that when the object to be held is inserted, the clamping force is as great as the clamping force in accordance with holding the object in the clamping reception. Hence follows that there is no change of the clamping force, which is connected with the following disadvantages.

A first disadvantage is that it is difficult to equip such packaging container, because the object to be held must be inserted in the clamping reception by overcoming the clamping force (with partial considerable force to be applied by the hand) of said clamping reception.

If the object is a sharp-edged tool or the like this will result in injuries of the hand due to the insertion force or holding force necessary to operate the tool.

A further disadvantage is that the clamping force can in no way be increased if the object is held in the clamping reception. The cap covering the base has no function when this object is held.

Therefore, it is the problem of the invention to further develop a packaging container of the kind mentioned above as such that the object to be held and clamped can be inserted in the clamping reception relatively easy and is held there with a great holding force.

SUMMARY OF THE INVENTION

For the solution of the problem set the invention is a packaging container for clamping a tool comprising a base and an attachable protective cap. The clamping base comprises a clamping holder with at least one elastic clamping jaw that defines a clamping reception into which the tool may be inserted. The protective cap abuts an outside circumference of the clamping jaw when the cap is attached to the clamping base. The attachment of the cap to the clamping base prestresses the clamping jaw in a direction of the clamping reception.

It is important that the base is developed as a clamping holder which, at least, forms one clamping jaw or alternatively a series of clamping jaws arranged at the circumference and uniformly distributed, which clamping jaws are fastened at the base unilaterally springy as upright flexible elements and that the prestressed cap is acting at least on the area of the edges of the clamping jaws elastically deformingly in order to prestress said clamping jaws elastically in direction of the clamping reception.

The technical teaching of the present invention includes also a single springy clamping jaw. In this case it is sufficient to press with one single assigned area of the edge or wall of the cap on this clamping jaw and deform it elastically. In this case the deformation is carried out against an abutment provided in the clamping holder.

However, for simplification reasons it is assumed in the following description that at least two diagonal opposing clamping jaws are provided which are deformed radially inwardly by assigned wall or edge areas of the cap in direction of the clamping reception accordingly.

In comparison with the prior art the given technical teaching results in the advantage that, only by means of the cap if it is attached to the base, the clamping force of the clamping holder is increased considerably.

In accordance with the invention particular areas of the cap shall serve to abut form-lockingly against the outside of the clamping jaws when the cap is slid on the clamping holder and prestresses the clamping jaws elastically radially inwardly in direction of the clamping reception in order to decrease the diameter in the clamping reception.

This results in the advantage that, if the cap is removed, an object to be held can be easily inserted in the clamping reception being still open. Therefore, minor insertion forces are required only to insert this tool or the object in the clamping reception of the clamping holder being still open. Conditioned by high insertion forces being necessary to be applied injuries of the hand resulting from a sharp-edged tool are avoided.

Only if the cap is attached to the base particular edges or areas of the wall of the cap abut against the outside circumference of the clamping jaws in order to move said clamping jaws radially inwardly in direction of the clamping reception and decrease the clamping diameter as such.

This means that, only if the cap is attached to the base, the necessary and desired high clamping force is achieved. By this such high clamping forces can be achieved which would never have been achieved in accordance with the prior art on usual insertion of a tool in a clamping holder.

This results in the considerable advantage that very heavy objects are also held safely in the clamping reception of the clamping holder. For example, such heavy objects are drills, milling cutters, and other tools, and/or instruments made of heavy metal having a high density which require to be protected against damages in a particular way and also if the packaging falls down.

In a first embodiment of the invention it is provided that the areas of the edges of the cap abut against the corresponding circumference of the clamping jaw, because these edge areas are particularly resistant against deformation and by this significant deformation forces can be transmitted by the cap to the clamping jaws.

However, the invention is not limited to this. It may also be provided that the areas of the wall of the cap being between the areas of the edges (in the area of the foot of the cap) are provided to abut against the clamping jaws form-lockingly. However, the areas of the wall of the cap being between the areas of the edges bulge slightly which results in an impairment of the pressing force of these areas of the wall in direction of the clamping jaws.

Also, a combination of both embodiment examples mentioned above (initiation of forces by the areas of the edges and initiation of forces by the areas of the walls of the protection cap being between the areas of the edges) may be provided.

However, for the sake of simplicity it is assumed in the following embodiment example that the areas of the edges of the cap transmit the flexible deformation force to the clamping jaws.

For this purpose it is preferred if the corresponding diagonal opposing ranges of the edges act on the corresponding diagonal opposing clamping jaws, because by this the clamping force is maintained stable and centered in the middle of the clamping reception.

Therefore, in case of a tetragonal packaging having a tetragonal base and a tetragonal cap a minimum of two opposing clamping jaws with two corresponding edge areas of the cap may be capable of being abutted.

However, in an extended embodiment example it is preferred if four clamping jaws and also four corresponding areas of the edges of the cap are forced into engagement.

In order to avoid that the cap is removed from the clamping base unintentionally (in the area of the clamping jaws) it may be provided that stop ribs each are arranged in the external area of the clamping jaw and that either locking steps, locking knobs, or other friction-increasing elements are arranged at these stop ribs which make it more difficult to remove the cap from the base.

Instead of a tetragonal base there are a plurality of possibilities existing to realize other base forms as well. Apart from mere quadratic or rectangular bases with preferred four clamping jaws arranged uniformly distributed at the circumference it is therefore also possible to develop triangular packagings with, for example, three clamping jaws arranged distributedly or even develop hexagonal or octagonal packagings with clamping jaws arranged accordingly.

Apart from a fully symmetrical form of a base even deviating forms of said fully symmetrical form may be realized. Therefore, instead of triangular, tetragonal, or many-sided packagings even round packagings may be used so that it is also possible to form such clamping receptions for cigarette packagings.

If such a jacket-shaped or cylindrical-shaped packaging is selected it is up to the user how many clamping jaws are arranged by him/her at the internal circumference of the clamping holder.

The same applies to so-called multiple clamping bases, where it is provided that a plurality of round or angular bases are developed in one piece serially or in parallel with each other and form one single continuous base having a plurality of clamping receptions. In accordance with the technical teaching of the present invention all clamping receptions are also prestressed elastically when a cap is attached and therefore, they receive the object to be held there.

The subject matter of the invention does not result in the subject matter of the individual patent claims only, but also in the combination of the individual patent claims with each other.

All information provided and all features disclosed in the documents including the summary, in particular, the spatial development shown in the drawings are claimed as being the essence of the invention to the extent that, in comparison with the prior art, they are new individually or combined with each other.

As follows the invention is explained in detail on the basis of drawings showing one way of an arrangement only. By this further features being the essence of the invention and advantages of the invention emerge from the drawings and their description.

DETAILED DESCRIPTION

Figure 1:
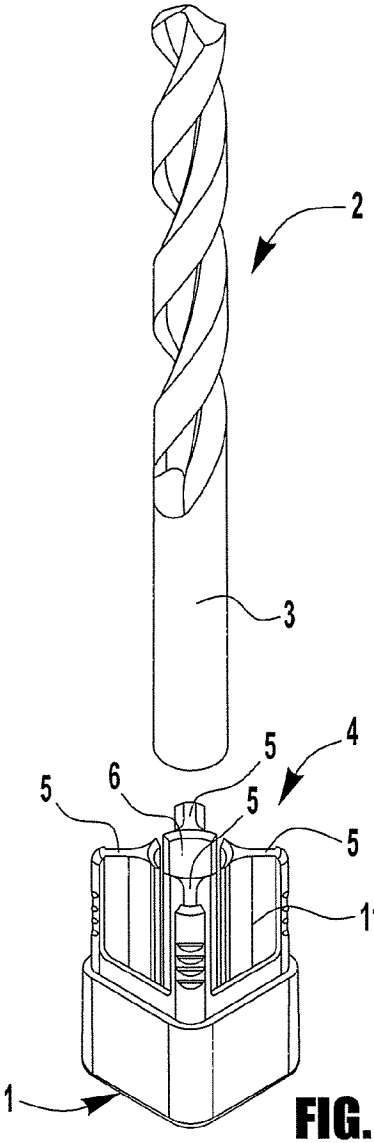
FIG. 1: is a perspective view of a base with a tool to be held there.

FIG. 1 shows a base 1 having a nearly quadratic cross-section developed preferably of a plastic material. Base 1 forms a clamping holder 4 which is formed of four clamping jaws 5 which are separated from each other elastically by longitudinal slots 14 extending in axial direction. In this way clamping jaws 5 may move in direction of arrow 17 (see FIG. 7) inwardly in direction of a central clamping reception 6 to clamp a tool 2 to be inserted there in the area of its shaft 3.

It is important that, with no cap attached, clamping reception 6 develops a greater diameter in comparison with the same diameter if a cap has been attached.

Therefore, in the position shown in FIG. 1 shaft 3 may be inserted in clamping reception 6 with the help of minor insertion force applied and is held there slightly only. This can be seen in FIG. 2.

However, if a protective cap 7 is attached to base 1 in direction of arrow 8 the areas of the edges 10 of the protective cap abut form-lockingly against the outside circumference of the corresponding clamping jaw 5.

Each clamping jaw comprises an external stop rib 12 which leads over a load-transmitting cross-piece 11 having a reduced diameter in direction of the internal clamping jaw 5.

Furthermore, all parts shown in FIG. 1 are plastic sprayed die castings made in one piece.

It may be provided that the internal surface of clamping jaws 5 (thus, they define clamping reception 6) is coated with a friction-increasing material. Such material may, for example, be a colour or a coating separated from the material of the base, or corrugations, knobs, projections, and the like may be arranged in the area of these clamping receptions.

Also, the whole material of clamping holder 4 may consist of a friction-increasing plastic material already, where the plastic material of clamping holder 4 may be developed separately from the other plastic material of base 1. Nevertheless, both plastic materials form one piece, because they have been produced with two different plastic materials in the course of one single die-casting process. This is a so-called 2K die-casting technology.

Figure 3:
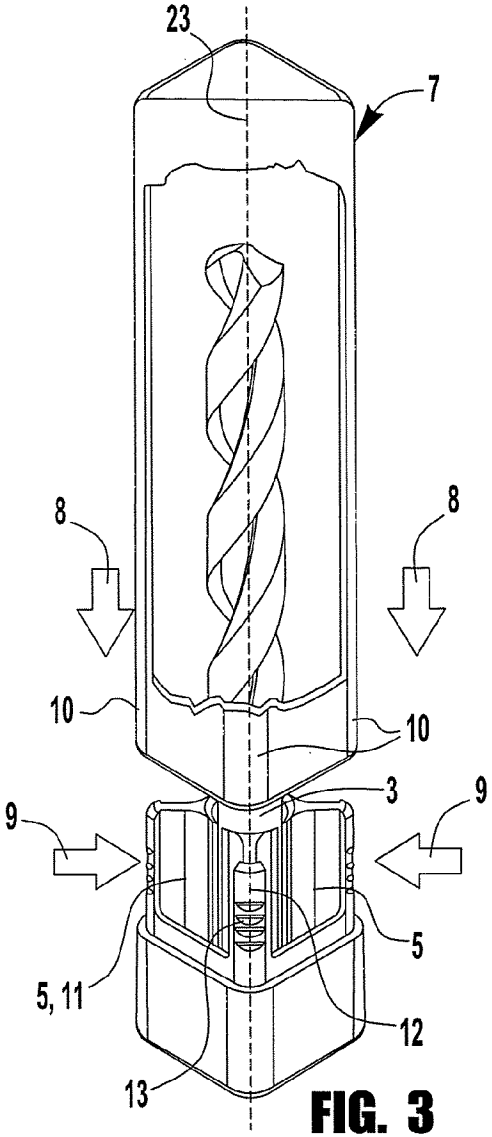
FIG. 3: is the representation in accordance with FIG. 2 with a protective cap capable of being slid on the base.
Figure 2:
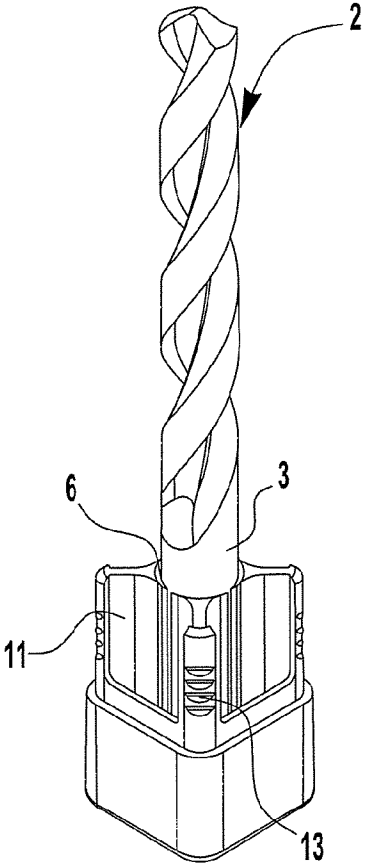
FIG. 2: is the representation in accordance with FIG. 1 with the tool inserted in the base.

Moreover, FIGS. 2 and 3 show that friction-increasing locking steps 13 are still arranged at the outside circumference of stop ribs 12 and, if necessary, friction-increasing locking steps or knubs may oppose said friction-increasing locking steps 13 and be arranged at the inner side of the corresponding areas of edges 10 in the area of protective cap 7.

Figure 4:
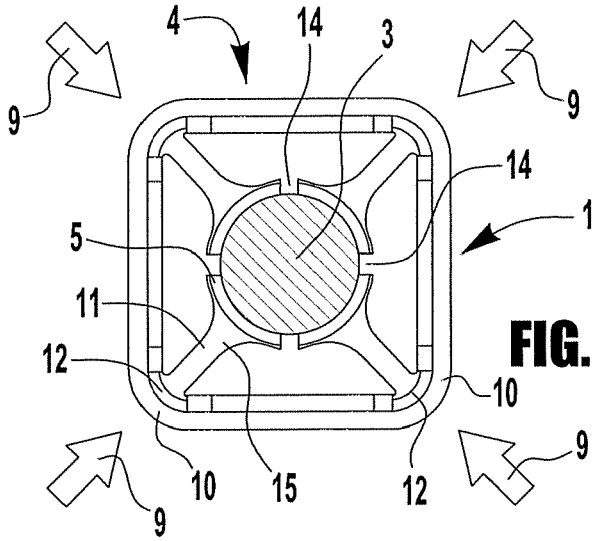
FIG. 4: is a sectional view of the arrangement in accordance with FIG. 3 with a protective cap fully slid on the base.
Figure 5:
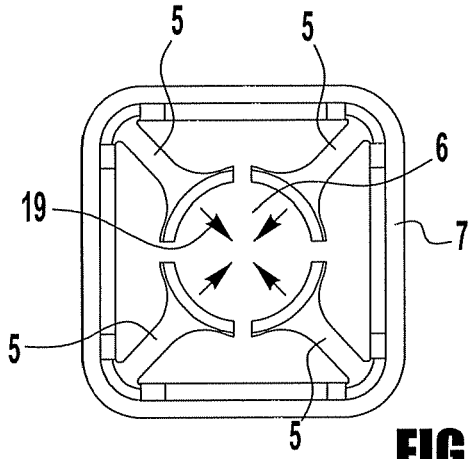
FIG. 5: is the same representation shown in FIG. 4 with further details provided.
Figure 6:
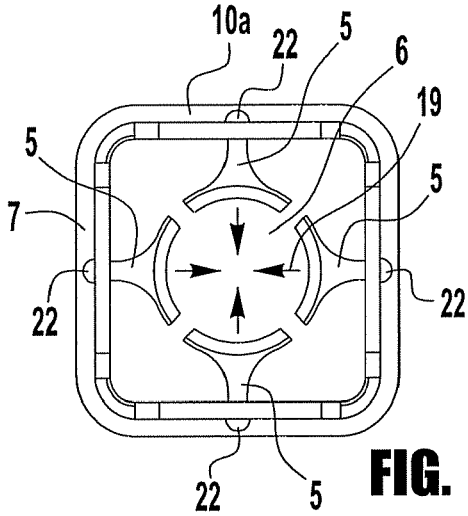
FIG. 6: is a modified embodiment example in comparison with FIG. 5.

FIG. 4 shows the function principle of the invention on the basis of a tetragonal base 1. There it can be seen that the areas of edges 10 of the protective cap abut form-lockingly against stop) ribs 12 and displace them in radial direction inwardly in direction of arrow 9 into clamping reception 6 so that clamping jaws 5 abut with great holding force against the outside circumference of shaft 3 of tool 2.

For a favorable initiation of the force it is preferred if clamping jaws 5 with their cross-pieces 11 and stop ribs 12 applied in one piece are also arranged in the areas of the edges of base 1. In this way the clamping force may be transmitted with a high force transmission direction from the areas of edges 10 of protective cap 7 to internal clamping jaws 5.

Longitudinal slots 14 arranged in axial direction between clamping jaws 5 serve to develop clamping jaws 5 elastically springy.

Seen from the mechanical point of view these are spiral springs clamped unilaterally which develop clamping holder 4 and (in a preferred way) are connected at their bottom side with base 1 in one piece, and their upper free ends are developed as flexible clamping elements and develop clamping jaws 5 directed inwardly.

It can still be seen in FIG. 4 that cross-pieces 11 having a relatively small thickness change over into clamping jaws 5 in the form of thickened stiffenings 15, and, as a consequence thereof, clamping jaws 5 abut form-lockingly over a range of an angle of 110 degrees against the outside circumference of shaft 3. This offers a good mechanical transmission of force and provides a high resistance to rupture in this area.

Of course, the length of the clamping surface of clamping jaws 5 may also be developed smaller in direction of the circumference.

It is also possible that the clamping surfaces of clamping jaws 5 do not extend over the whole axial length (insertion depth) in base 1 but are arranged in a particular upper area only.

In comparison with FIGS. 1 through 5, FIG. 6 shows a modified embodiment example, where it can be seen that clamping jaws 5 are arranged at the inner sides of the base (therefore, they are outside the area of the edges) and, as a consequence thereof, assigned laminar wall areas 10*a* of the protective cap act power-transmittingly on these clamping jaws 5 and prestress them elastically in clamping reception 6 in direction of arrow 19.

In this case it is preferred if wall area 10*a* of cap 7 presses on a corresponding knub 22 stationarily connected with the base in order to deform the clamping jaw radially inwardly as such, which clamping jaw is formed at knub 22.

Figure 7:
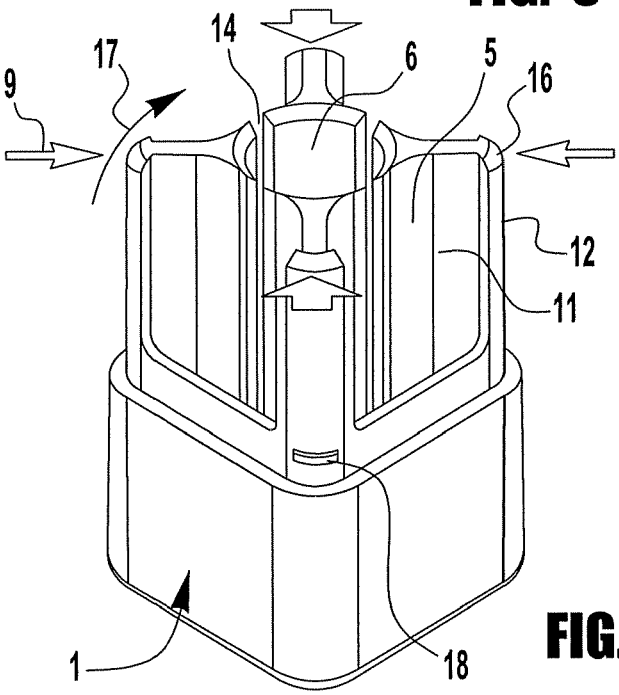
FIG. 7: is a similar representation of FIG. 2 including further details.

FIG. 7 shows an enlarged representation of FIGS. 1 through 3 of a base 1, where it can be seen that, instead of locking steps 13 represented in FIG. 3, one or several locking knubs 18 may be arranged in the area of stop ribs 12 of clamping jaws 5.

Figure 8:
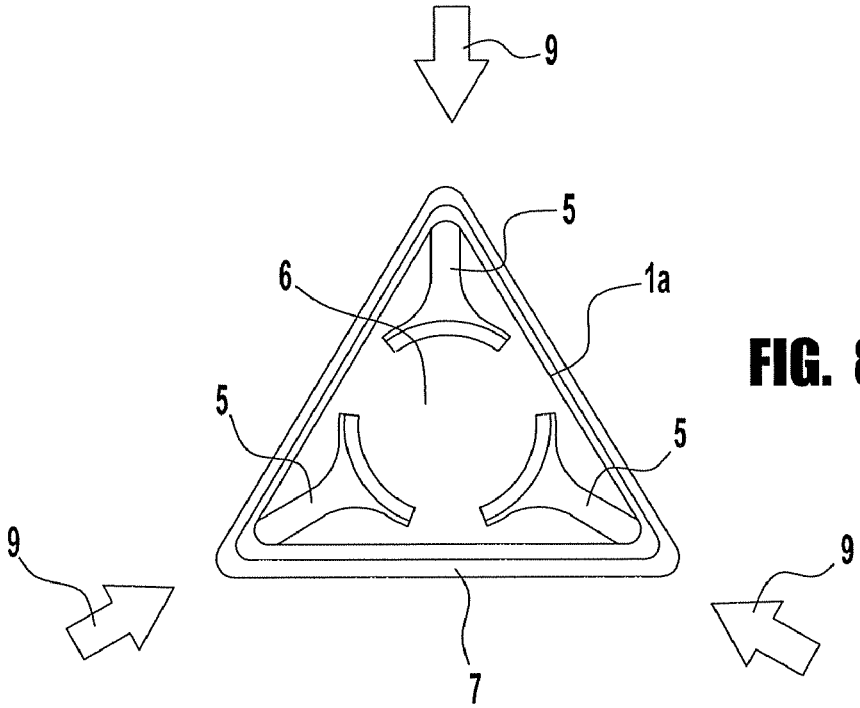
FIG. 8: is a sectional view of a triangular packaging.

FIG. 8 shows a so-called trihedral packaging, on which trihedral packaging a triangular protective cover 7 is slid on a assigned triangular base 1*a*. Here clamping jaws 5 are also arranged in the area of the edges of the triangular base, and therefore, they form the central clamping reception 6.

Figure 9:
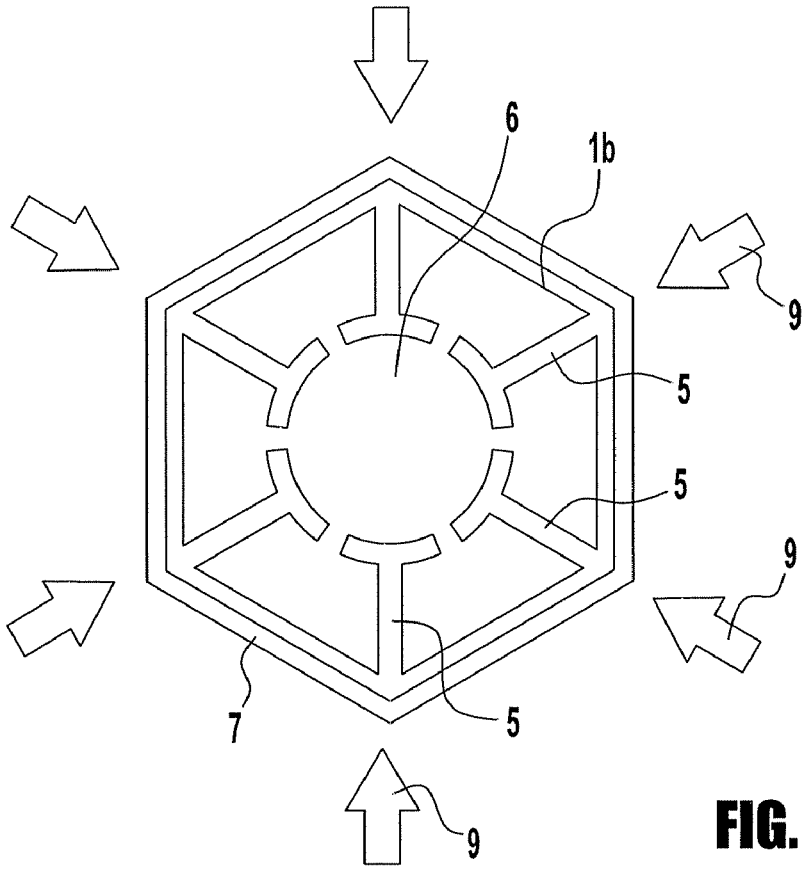
FIG. 9: is a sectional view of a hexagonal packaging.

The same conditions are represented on the basis of a hexagonal packaging shown in FIG. 9. Here a corresponding hexagonal protective cover 7 covers a hexagonal base 1*b* which, with a plurality of clamping jaws 5, forms a clamping reception 6, the diameter of which clamping reception is elastically reducible as soon as the protective cover is attached to the base.

Figure 10:
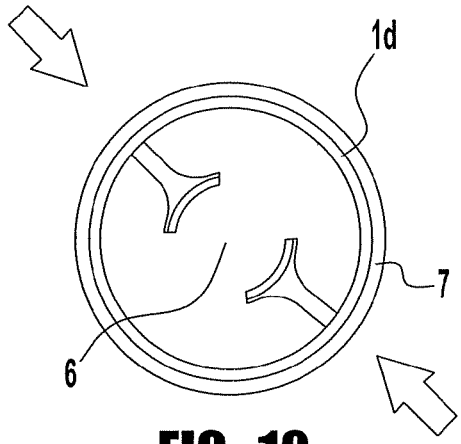
FIG. 10: is a sectional view of a cylinder-shaped packaging in a first embodiment example.
Figure 11:
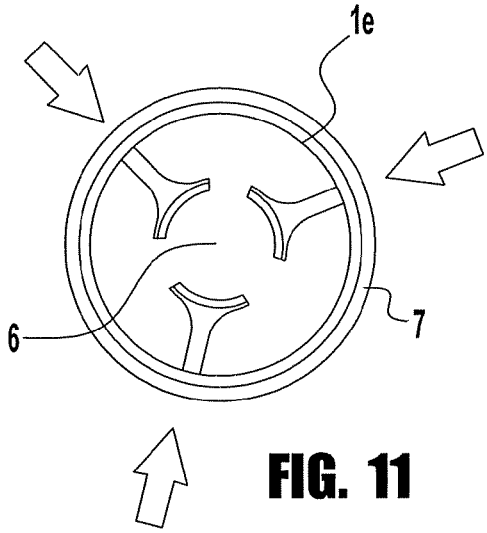
FIG. 11: is a sectional view of a cylinder-shaped packaging in a second embodiment example.
Figure 12:
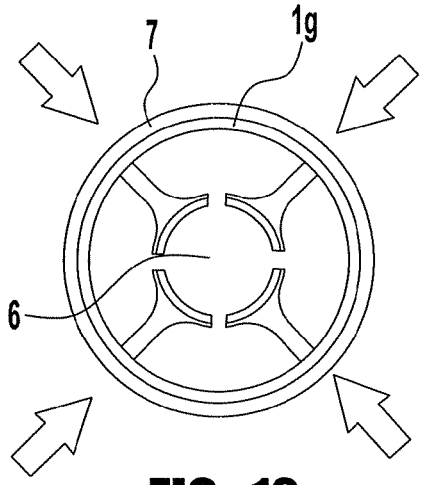
FIG. 12: is a sectional view of a cylinder-shaped packaging in a third embodiment example.

A series of different embodiments of cylindrical packagings are represented in FIGS. 10 through 12. Here a cylindrical protective cap 7 covers base 1*d* which has also been developed cylindrically, where diagonal opposing clamping jaws 5 are provided which, as a consequence thereof, are displaced elastically springy inwardly in direction of clamping reception 6 in direction of arrow 9 when protective cover 7 is attached.

The same conditions apply to a base 1*e* which differentiates from base 1*d* as such that three clamping jaws altogether are arranged uniformly distributed at the circumference at the inner side of base 1*e*.

FIG. 12 shows four of such clamping jaws 5 which are again uniformly distributed at the circumference at the inner side of a base 1*g* and are connected in one piece with the material of the base itself.

Of course, the round packagings shown here may be secured against rolling away on a flat surface by outside fins, projections, and the like (not shown). Such projections project over the outside circumference of the base and/or protective cover.

Figure 13:
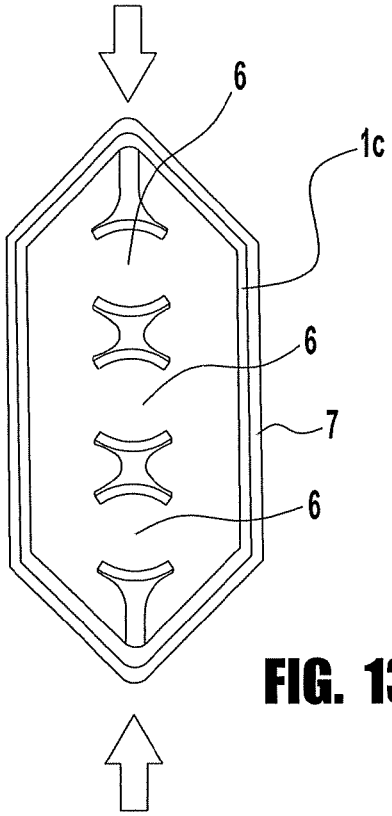
FIG. 13: is a sectional view of a many-sided packaging with several clamping receptions arranged in series.
Figure 14:
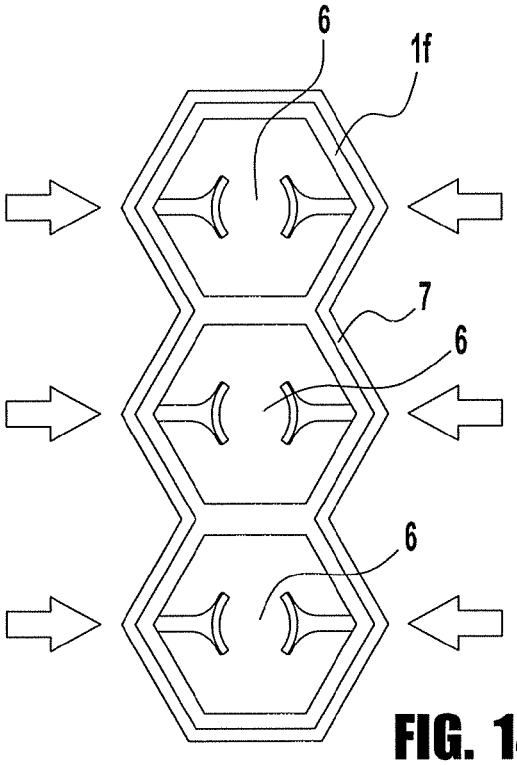
FIG. 14: is a sectional view of a many-sided packaging with clamping receptions arranged in parallel to each other.

FIGS. 13 and 14 represent multiple clamping receptions.

In accordance with FIG. 13 three clamping receptions altogether are arranged serially in tandem in a base 1*c*. A clamping force can be applied on all clamping receptions only if a corresponding object has been received by all clamping receptions, because the clamping force is transmitted from one side over all clamping receptions to the other side. Instead of such serial application of the clamping force a parallel application of the clamping force with a packaging in accordance with FIG. 14 may be provided.

By this it can be recognized that the packaging comprises a many-sided base 1*f* which, for example, comprises hexagonal base elements connected with each other and that a single, many-sided protective cap 7 is slid over the whole arrangement, where each clamping jaw prestresses the assigned clamping reception elastically springy immediately as soon as the protective cap has been slid over the whole arrangement.

It is within the limits of the present invention if in the area of the upper part of stop rib 12 an insertion slope 16 is arranged to improve the sliding of a protective cap on clamping holder 4 of base 1.

It is also within the limits of the invention if stop rib 12 is developed conically, i.e., it forms an angle to the central longitudinal axis 23 to form a conical insertion slope 16 for sliding protective cap 7.

Figure 15:
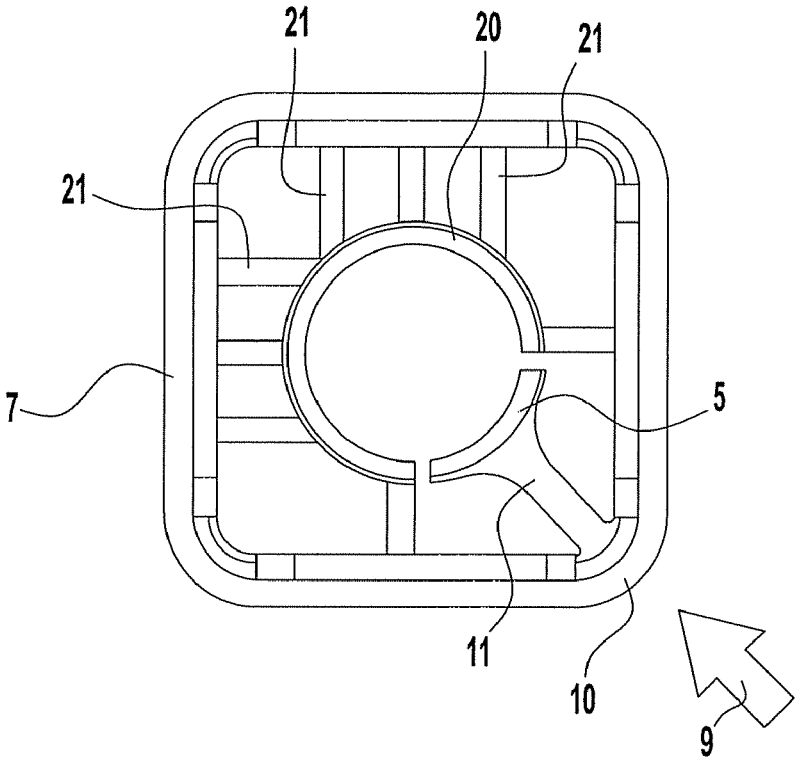
FIG. 15: is a sectional view of a further embodiment of the invention with one clamping jaw capable of being deformable elastically.

Another embodiment is represented in FIG. 15, where a single springy clamping jaw 5 is provided only which is prestressed elastically by an edge area 10*a* of cap 7 in direction of arrow 9 into clamping reception 6.

The elastic prestressing of clamping jaw 5 is caused against an abutment 20 which forms the remaining part of the clamping reception as a non-elastic part and is supported by cross-pieces 21 against base 1.

Figure 16:
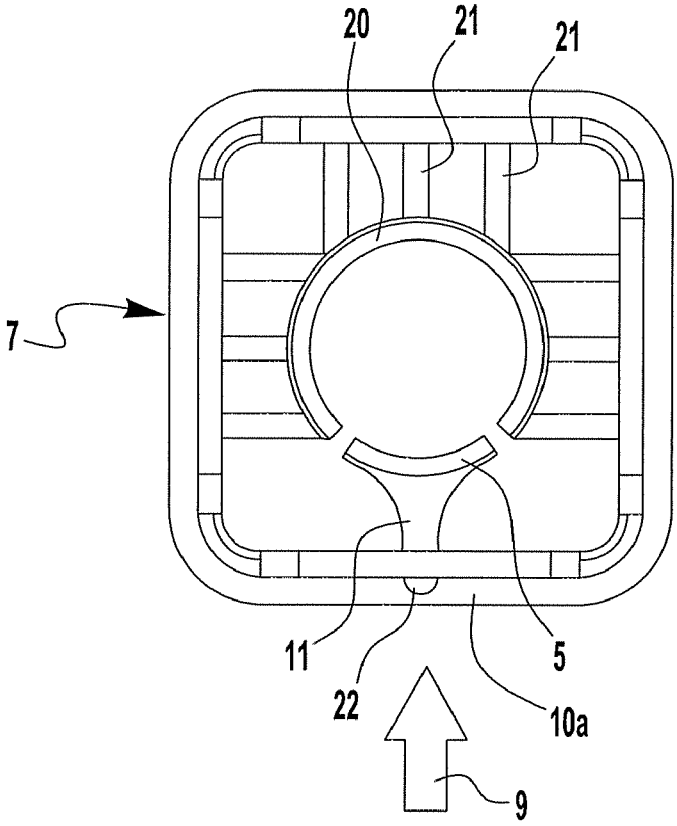
FIG. 16: is a modified embodiment example in comparison with FIG. 15.

A modification of FIG. 15 is represented in FIG. 16 with the representation that a wall area 10*a* of cap 7 presses on a knub 22 stationarily connected with the base 1 in order to displace cross-piece 11 radially inwardly, at which cross-piece 11 clamping jaw 5 has been formed. This results in a reduction of the clamping diameter. The deformation of the clamping jaw attached on one side is carried out against an abutment 20 stationarily connected with the base 1.

It is preferred that all bases 1 represented in the drawings and the appropriate caps consist of a plastic material. It is preferred that the plastic material of the cap 7 is transparent or at least translucent. However, the invention is not limited to this. It may also be provided that the cap 7 consists of a cardboard material, a sandwich structure made of cardboard and plastic material, or a metal material. Also, it is not necessary that the cap 7 is closed at the front side opposing the base 1. It may also be provided to insert another base 1 with a clamping reception in the cap from this open front side. Then two clamping bases are opposing each other which are operated by the cap 7 open at both front sides.

While the foregoing has been set forth in considerable detail, it is to be understood that the drawings and detailed embodiments are presented for elucidation and not limitation. Design variations, especially in matters of shape, size and arrangements of parts may be made but are within the principles of the invention. Those skilled in the art will realize that such changes or modifications of the invention or combinations of elements, variations, equivalents or improvements therein are still within the scope of the invention as defined in the appended claims.

| Drawing Legend | |
|---|---|
| 1 | base 1a, 1b through 1g |
| 2 | tool |
| 3 | shaft |
| 4 | clamping holder |
| 5 | clamping jaw clamping reception |
| 7 | protecting cap |
| 8 | direction of arrow |
| 9 | direction of arrow |
| 10 | edge range 10a |
| 11 | cross-piece |
| 12 | stop rib |
| 13 | locking step |
| 14 | longitudinal slat |
| 15 | stiffening |
| 16 | insertion slope |
| 17 | direction of arrow |
| 18 | locking knub |
| 19 | direction of arrow |
| 20 | abutment |
| 21 | cross-pieces |
| 22 | knub |

I claim:

1. A packaging container for clamping a tool, said packaging container comprising:

a clamping base that includes a clamping holder with at least one elastic clamping jaw with a surface that defines a portion of a clamping reception into which said tool can be inserted, said clamping holder also having a load-transmitting cross-piece that is connected to the clamping jaw, said load-transmitting cross-piece having a reduced thickness in comparison to the clamping jaw; and a protective cap that is attachable to said clamping base, said protective cap abutting an outside surface of said clamping holder at times when said protective cap is attached to said clamping base, said attachment of said protective cap to said clamping base prestressing said clamping jaw through said cross-piece in a direction of said clamping reception.

2. A packaging container according to claim 1 wherein said protective cap comprises at least one edge area that abuts against said clamping holder.

3. A packaging container according to claim 1 wherein said protective cap comprises at least one wall area that abuts against said at least one load-transmitting cross-piece.

4. A packaging container according to claim 1 further comprising an abutment that is stationarily connected to said base, said at least one clamping jaw and said abutment cooperating to define said clamping reception.

5. A packaging container according to claim 1 comprising at least two clamping jaws that define said clamping reception.

6. A packaging container according to claim 1, said at least one load-transmitting cross-piece being arranged in an edge area of said base.

7. A packaging container according to claim 1, said at least one load-transmitting cross-piece being arranged in a wall area of said base.

8. A packaging container according to claim 1, said at least one clamping jaw having a friction-increasing coating.

9. A packaging container according to claim 1 wherein said clamping holder is comprised of a friction-increasing material.

10. A packaging container according to claim 1 wherein said clamping holder further comprises at least one stop rib that is arranged in an outside area of each of said clamping jaws.

11. A packaging container according to claim 1 wherein said clamping holder includes four clamping jaws that are separated from each other by longitudinal slots extending in an axial direction.

12. A packaging container according to claim 10 wherein said stop rib leads over said load-transmitting cross-piece toward said clamping jaw.

13. A packaging container according to claim 1 wherein said at least one clamping jaw defines at least two clamping receptions.

14. A packaging container according to claim 13 wherein said at least two clamping receptions are operable by said protective cap.

15. A packaging container according to claim 1 further comprising knubs that are stationarily connected to said base, said knubs being arranged in an area of said base such that wall areas of said protective cap deform said clamping jaw at times when such wall areas are abutted against said knubs.

16. A packaging container according to claim 10 wherein each of said stop ribs includes at least one friction-increasing element that opposes removal of said cap from said base.

17. A packaging container according to claim 16 wherein said friction-increasing element is a locking step.

18. A packaging container according to claim 16 wherein said friction-increasing element is a locking knub.

19. A packaging container according to claim 13 wherein said at least two clamping receptions are arranged serially in tandem in said clamping base.

20. A packaging container according to claim 13 wherein said at least two clamping receptions are arranged in parallel to each other in said clamping base.

21. A packaging container for clamping a tool, said container comprising:

a clamping base having clamping holder with at least one elastic clamping jaw with a surface that defines a clamping reception into which said tool may be inserted, said clamping holder also having a stop rib and a load-transmitting cross-piece that is located between the clamping jaw and the stop rib, said load-transmitting cross-piece having a reduced thickness in comparison to the stop rib; and a protective cap abutting an outside surface of said clamping jaw at times when said cap is attached to said clamping base, said attachment of said cap to said clamping base prestressing said clamping jaw through said stop rib and said cross-piece in a direction of said clamping reception.

22. The packaging container of claim 21 wherein the stop ribs of said clamping holder cooperate with respective corners of said protective cap at times when said cap is attached to said clamping base.

* * * * *